United States Patent [19]

Weaver

[11] 4,076,193

[45] Feb. 28, 1978

[54] TRANSOM MOUNT FOR FISHING MOTOR

[75] Inventor: Lester C. Weaver, Fayetteville, Ark.

[73] Assignee: Shakespeare of Arkansas, Inc., Fayetteville, Ark.

[21] Appl. No.: 751,468

[22] Filed: Dec. 17, 1976

[51] Int. Cl.[2] ..... B63H 21/26

[52] U.S. Cl. ..... 248/4; 115/17

[58] Field of Search ..... 248/4, 291; 115/17, 115/18 R

[56] References Cited

U.S. PATENT DOCUMENTS

| | | | |
|---|---|---|---|
| 2,646,238 | 7/1953 | Kircher et al. | 248/4 |
| 3,424,412 | 1/1969 | Gayle | 248/4 |
| 3,578,277 | 5/1971 | Osborn | 248/4 |
| 3,698,672 | 10/1972 | Gilbert | 248/4 |
| 3,874,318 | 4/1975 | Langley | 248/4 |

*Primary Examiner*—Marion Parsons, Jr.

*Attorney, Agent, or Firm*—Hamilton, Renner & Kenner

[57] ABSTRACT

A mount having a clamp for mounting the motor tube of a fishing motor on the transom of a boat for swinging between a vertical operating position and a horizontal stowed position over the boat. A yoke for holding the motor tube is swiveled on the clamp and a manually releasable catch bracket pivoted on the yoke locks the yoke to the clamp in the operating position. A biased clip on the clamp releasably locks the yoke in the stowed position.

3 Claims, 6 Drawing Figures

TRANSOM MOUNT FOR FISHING MOTOR

BACKGROUND OF THE INVENTION

Certain prior devices for mounting fishing motors on the transom of a boat have been complicated and expensive to construct and difficult to install and operate. Moreover, certain of such devices have required manipulation of locking devices to lock as well as to release the motor tube in the operating and stowed positions, and require aligning adjustments each time the motor is removed and remounted on the boat.

SUMMARY OF THE INVENTION

The present invention provides an improved simple and inexpensive transom mount for a fishing motor having a transom clamp and an easily manipulated swivel yoke for holding the motor tube and means for locking the swivel yoke in operating and stowed positions.

Another object is to provide novel manually releasable catch means for automatically locking the swivel yoke and motor tube in the operating and stowed positions when the tube is swung from one position to the other.

A further object is to provide improved means for adjusting the alignment of the motor tube relative to the inclination of the transom so that the mount may be removed or reinstalled on the same boat without readjustment.

Another object is to provide cooperating abutment means on the transom clamp and swivel yoke for limiting the swinging movement of the swivel yoke in either direction.

These and other objects are accomplished by the improvements comprising the present invention, a preferred embodiment of which is shown by way of example in the accompanying drawings and described in detail in the following specification. The scope of the appended claims is intended to embrace detailed changes in construction.

DESCRIPTION OF A PREFERRED EMBODIMENT

Figure 1:
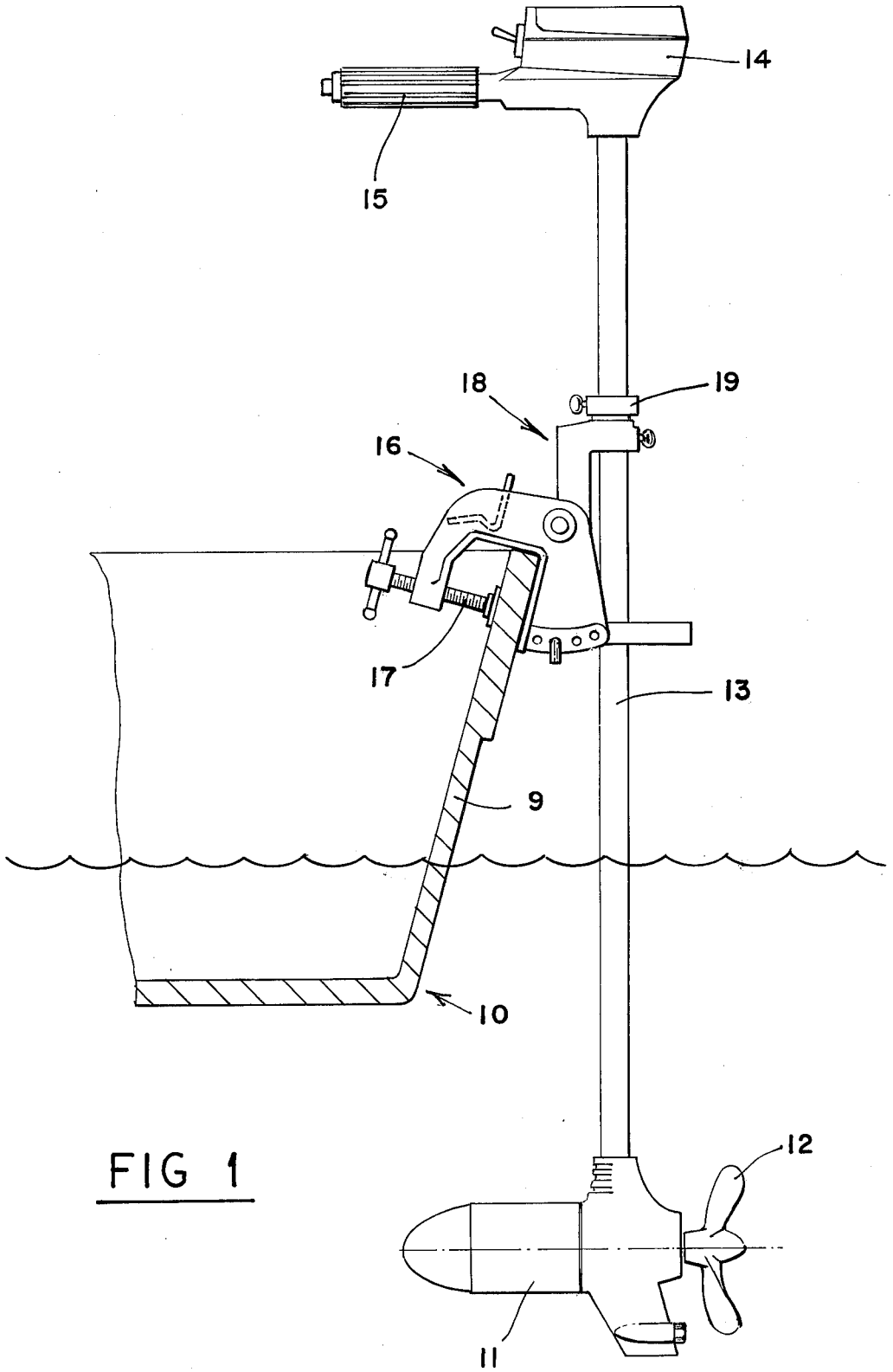
FIG. 1 is a side elevation of the improved transom mount clamped onto the transom of a boat and holding the motor tube of an electric fishing motor in vertical operating position.

Referring first to FIG. 1, the improved transom mount is shown attached to the transom 9 of a boat indicated generally at 10, the electric motor 11 with its propeller 12 being shown in submerged operting position with its motor tube 13 extending vertically alongside the stern of the boat. The usual housing 14 containing switches and controls for the motor is mounted on the upper end of the tube 13 and has a forwardly projecting tiller or handle 15 for steering the thrust of the motor 11.

The clamp for attachment to the transom 9 is indicated generally at 16, and is secured by the clamp screws 17. The motor tube 13 is clamped in a yoke indicated generally at 18 swiveled on the clamp 16, and a collar 19 is adjustably clamped on the motor tube above the swivel yoke 18 to vertically position the motor in the submerged operating position. Preferably, the motor tube is retracted in the yoke to extend inwardly over the boat in the horizontal stowed position indicated in FIG. 4.

Referring to FIGS. 2 – 6, the clamp 16 is generally of an inverted U-shape for straddling the upper edge portion of the transom 9, one leg 20 having the clamp screws 17 threaded through bosses 21 in its lower end for abutting the inner surface of the transom and the other leg 22 having a flat inner wall **23*a* for abutting the outer surface of the transom. Preferably, the wall 23*a* is connected to wall portions 23*b* and 23*c* continuing around the inner periphery of the clamp to the bosses 21 on leg 20, and two laterally spaced flanges comprising connecting portions 24*a*, 24*b* and 24*c* extend outwrdly from the wall portions 23*a*, 23*b* and 23*c*** at right angles thereto.

The yoke 18 is swiveled on the clamp 16 by a swivel pin 25 mounted in the upper corners between flange portions **24*a* and 24*b*, and the lower ends of portions 24*a* are provided with a series of aligned holes 26 (FIG. 4) located along an arc swung about pin 25 as a center, for selectively receiving a catch pin 27**, for a purpose to be described.

The yoke 18 has an upper leg 28, a lower leg 29 and a channel-shaped web connecting the legs comprising an inner wall 30 and side flanges 31. The upper leg 28 is tubular for slidably receiving the motor tube 13, and a set screw 32 is provided therein for securing the tube. The lower leg 29 is also tubular and has an aligned aperture 33 for slidably receiving the motor tube. Preferably, the side flanges 31 of the web are provided with laterally aligned bearing bosses 35 through which the swivel pin 25 extends, and in the operating position of FIG. 2 the outer edges of flanges 31 approach abutment with the inner wall 23 of the clamp.

The inner end of leg 29 is provided with ears 37 in which a pin or rivet 38 is secured for pivotally mounting a U-shaped catch bracket having two legs 39 and a connecting cross bar 40. The legs 39 are pivoted on the rivet 38 along the outer sides of ears 37, and the outer free ends of the legs have upwardly open hook portions 41 adapted to engage the catch pin 27 in the yoke in the operating position shown in FIG. 2. A catch spring 42 encircling rivet 38 and having its outer end 43 hooked over the cross bar 40 biases the hook portions 41 of the legs into engagement with catch pin 27 and the hooks may be released as indicated in phantom lines in FIG. 2 by pressing upwardly on the cross bar with the fingers against the spring bias.

Figure 2:
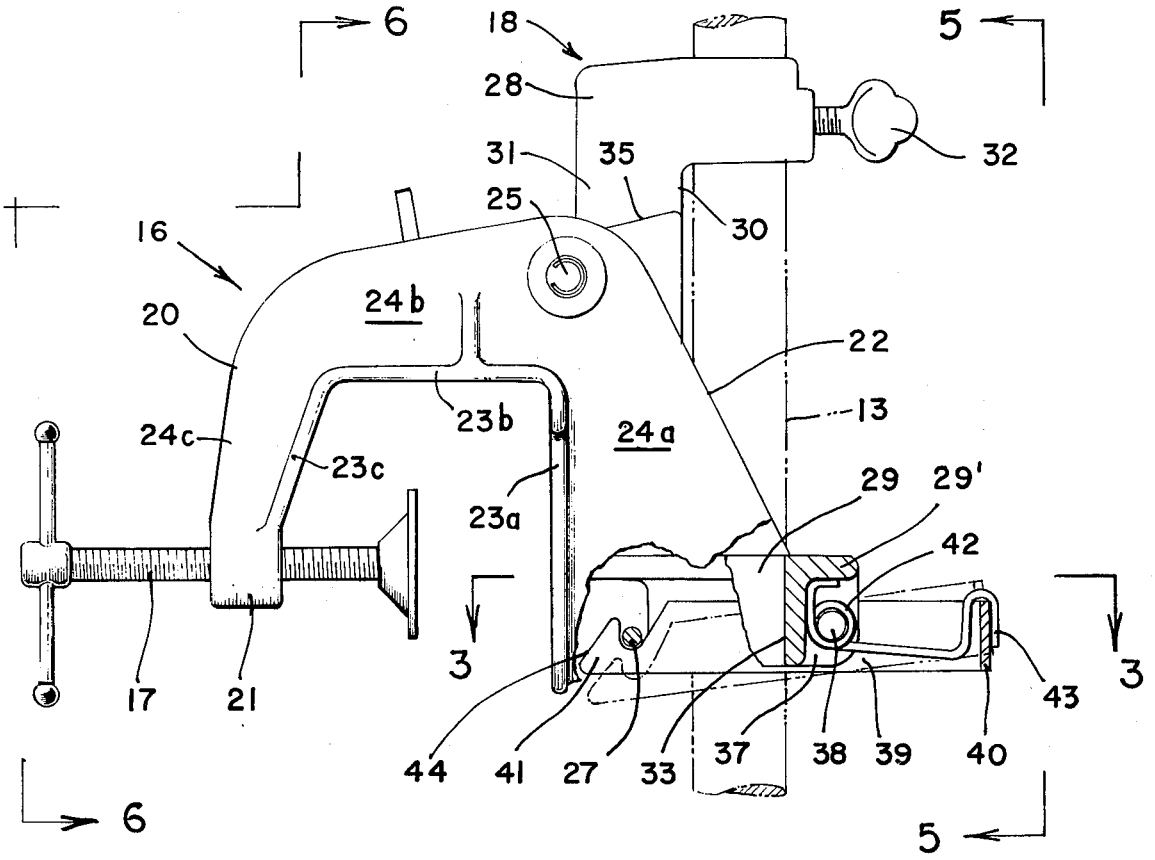
FIG. 2 is an enlarged detached side elevation of the transom mount with the motor tube in operating position, parts being broken away and in section.
Figure 3:
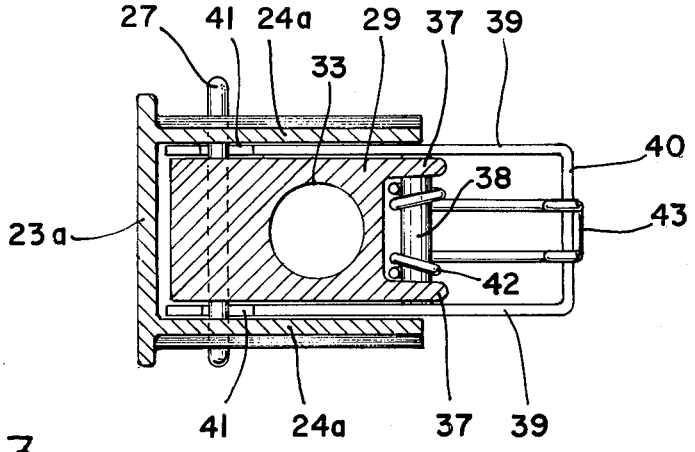
FIG. 3 is a plan sectional view on line 3—3 of FIG. 2.

The hook portions 41 are provided with inclined cam surfaces 44 on their outer ends so that when the yoke is swung approaching the vertical operating position of FIG. 2 the cam surfaces will slidably engage the catch pin 27 and automatically allow the action of spring 39 to snap the hooks into locking engagement with the pin 27.

Figure 4:
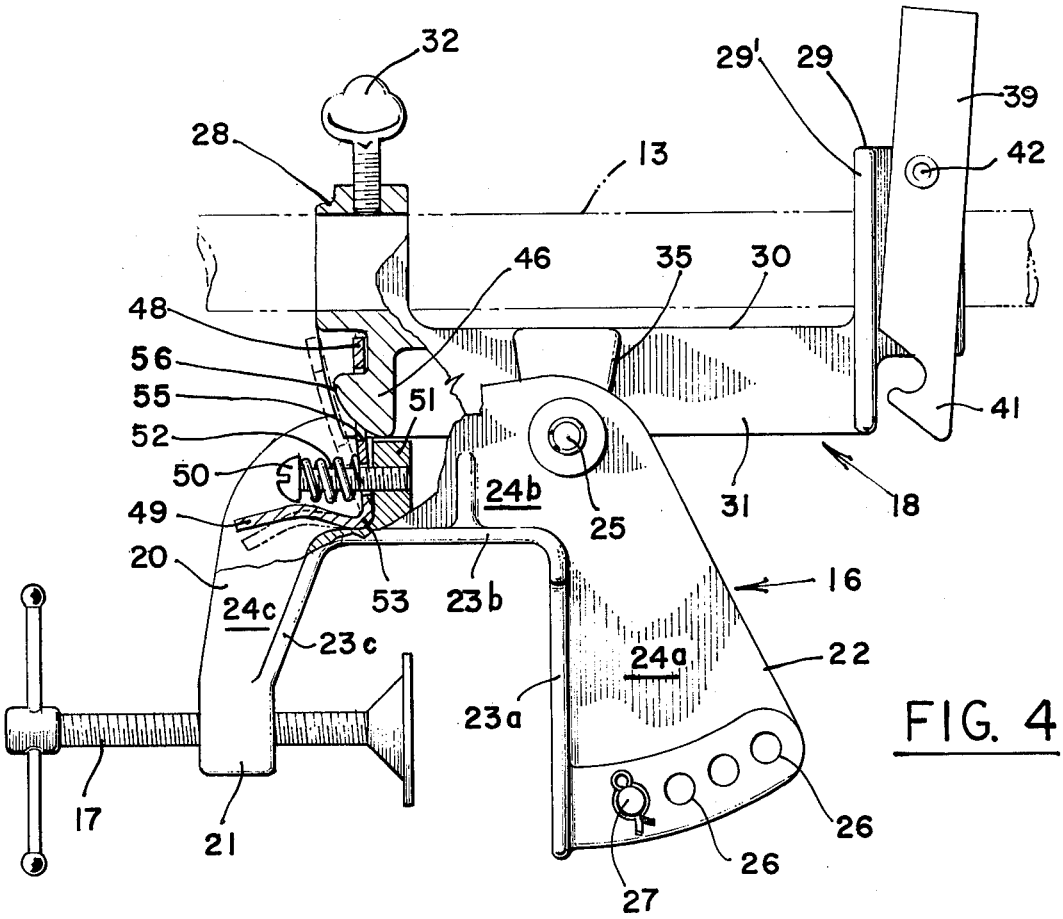
FIG. 4 is a side elevation similar to FIG. 2 showing the improved mount with the motor tube in horizontal stowed position, parts being broken away and in section.
Figure 5:
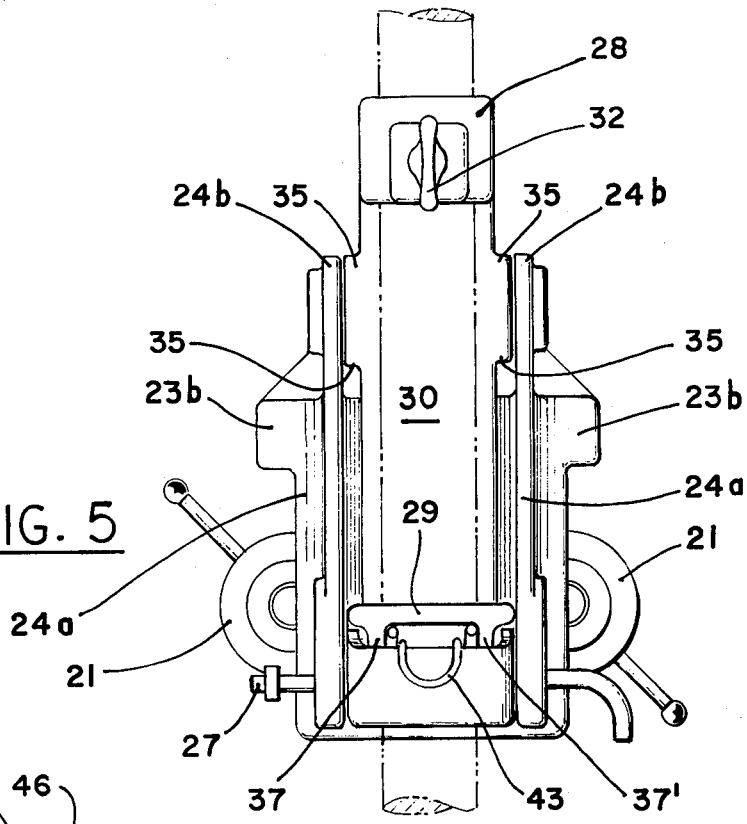
FIG. 5 is an end elevation from line 5—5 of FIG. 2.
Figure 6:
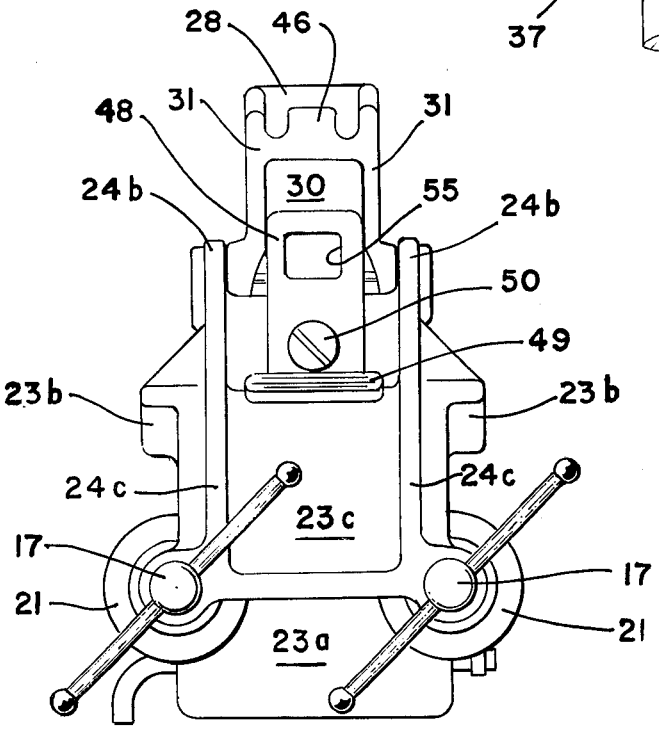
FIG. 6 is an end elevation from line 6—6 of FIG. 2.

As best seen in FIGS. 4 and 6, a hook 46 is formed on the leg 28 between the side flanges 31 of the web of yoke 18. A substantially L-shaped clip 47 having legs 48 and 49 is loosely mounted on a screw stud 50 secured in a rib 51 extending transversely between the flanges **24*b* of the clamp. Preferably the stud 50 extends through an enlarged hole in leg 48 and the leg is biased against the rib 51 by a compression spring 52 encircling the stud. The rounded apex 53** between the legs rockingly abuts a fillet at the base of the rib.

The leg 48 has a rectangular aperture 55 therein adapted to pass over the hook 46 and engage the outer end of the leg into the notcgh formed by the hook, and the spring 52 thus biases the leg into locking engagement with the hook. The hook has an inclined cam surface 56 to slidingly engage the outer end of leg 48 as the yoke approaches the stowed position of FIG. 4, so that the action of the spring 52 will automatically snap the clip into locking engagement with the hook when the stowed position is reached. The yoke is easily released by pressing with the fingers on leg 49 to rock the clip on its apex to the phantom position, and the leg 49 is preferably provided with an enlarged angled end portion to facilitate this action.

When the yoke reaches the stowed position the outer end of hook 46 abuts the transverse rib 51 to limit overswing of the yoke beyond the stowed position.

Assuming that the yoke 18 with the motor tube 13 clamped therein is in the operating position of FIG. 2, when it is desired to swing the tube to the stowed position of FIG. 4, the fisherman presses or lifts the cross bar 40 of the catch upwardly to the phantom position, releasing the hooks 41 from engagement with the catch pin 27 in clamp 16. The releasing movement of the catch is limited by abutment of the legs 39 with the top flange 29' of leg 29 of the yoke. The yoke can now be swung manually counterclockwise on pivot 25 and pressure on the latch released so that the spring 43 returns it to a position wherein the free end portions of the legs abut the flange 29', as shown in FIG. 4.

As the yoke approaches the stowed position of FIG. 4, the cam surface 56 of hook 46 rides over the outer part of leg 48 of the clip against the action of spring 52 which then snaps the aperture 55 over the hook and lockingly engages the leg 48 into the notch of the hook, and at the same time the end of the hook comes into abutment with the rib 51 of the clamp. In the stowed position the clamping screw 32 may be loosened and the motor tube 13 retracted over the boat.

To release the yoke for returning it to the operating position, the fisherman presses downwardly on leg 49 of the clip to rock it on its apex 53, which motion is yieldingly resisted by the pressure of spring 52 and is permitted by the loose fit of the stud 50 in the leg 48 of the clip. The yoke may now be swung clockwise toward the oerating position of FIG. 2, and as it approaches that position the cam surfces 44 of the hooks will ride over the catch pin 27 in the clamp and allow the catch spring 42 to automatically snap the hooks into locking engagement with the catch pin. Overtravel of the yoke is prevented by abutment of the yoke flanges 31 with the wall **23*a*** of the clamp.

The first time the iproved transom mount is installed on a particular boat the catch pin 27 is inserted in the pair of opposed holes 26 which is so related to the transom angle as to position the motor tube substantially vertical in the operating position. Thereafter, the mount may be removed and reinstalled on the same boat without changing the position of the catch pin.

It will be apparent that the improved transom mount is simple and inexpensive to manufacture and easily operated manually between operating and stowed positions where the motor tube is automatically locked as the yoke swings into those positions, there being abutment means on the clamp preventing overtravel of the yoke in either position.

I claim:

1. A transom mount for mounting the motor tube of a fishing motor on the transom of a boat, comprising a clamp adapted for gripping the transom, a yoke swiveled on said clamp, means on said yoke for holding said motor tube, said yoke adapted for swinging said motor tube between vertical operating position and horizontal stowed position, spring-biased catch means on said yoke to engage said clamp when the yoke is in operating position, and spring-biased clip means on the clamp to engage the yoke in the stowed position, said clip means being L-shaped having two legs extending angularly from an apex rockingly abutting said clamp, one leg for lockingly engaging said yoke and the other leg adapted to be manually pressed to rock the clip means and release the yoke.

2. A transom mount as defined in claim 1, wherein the catch means is manually releasable by finger pressure.

3. A transom mount as defined in claim 1, wherein the clamp has abutment means for abutting said yoke in the operating and stowed positions.

* * * * *